US010982859B2

(12) United States Patent
Folkers et al.

(10) Patent No.: US 10,982,859 B2
(45) Date of Patent: Apr. 20, 2021

(54) CROSS FIRE TUBE RETENTION SYSTEM

(71) Applicant: Chromalloy Gas Turbine LLC, Palm Beach Gardens, FL (US)

(72) Inventors: Daniel L. Folkers, Stuart, FL (US); Adam L. Hart, Stuart, FL (US)

(73) Assignee: Chromalloy Gas Turbine LLC, Palm Beach Gardens, FL (US)

( * ) Notice: Subject to any disclaimer, the term of this patent is extended or adjusted under 35 U.S.C. 154(b) by 126 days.

(21) Appl. No.: 16/178,688

(22) Filed: Nov. 2, 2018

(65) Prior Publication Data

US 2020/0141584 A1 May 7, 2020

(51) Int. Cl.
*F23R 3/48* (2006.01)
*F23R 3/60* (2006.01)

(52) U.S. Cl.
CPC . *F23R 3/48* (2013.01); *F23R 3/60* (2013.01)

(58) Field of Classification Search
CPC .. F23M 5/00; F23M 5/04; F23R 3/002; F23R 3/425–54; F23R 3/60; F23R 2900/00012; F23R 2900/00017
See application file for complete search history.

(56) References Cited

U.S. PATENT DOCUMENTS 4,077,205 A 3/1978 Pane et al.
4,249,372 A * 2/1981 White ..... F23R 3/48 60/39.37
6,681,578 B1 1/2004 Bunker
6,705,088 B2 3/2004 Martling et al.
6,912,838 B2 7/2005 Sileo et al.
7,007,482 B2 3/2006 Green et al.
7,386,980 B2 6/2008 Green et al.
7,540,156 B2 6/2009 Brown et al.
8,220,273 B2 7/2012 Iwasaki
8,544,277 B2 10/2013 Johnson et al.
9,511,447 B2 12/2016 Lin et al.
2004/0172952 A1* 9/2004 Sileo ..... F02C 7/264 60/800
2009/0044540 A1* 2/2009 Pangle ..... F02C 7/20 60/752
2014/0123619 A1* 5/2014 DiCintio ..... F23R 3/48 60/39.37
2016/0109135 A1* 4/2016 Kidder ..... F23R 3/50 60/796
2016/0209034 A1 7/2016 Maurer et al.
2018/0087693 A1* 3/2018 Dhanasekaran ..... B60K 15/01

OTHER PUBLICATIONS

PCT Application No. PCT/US19/59412, International Search Report and Written Opinion, dated Jan. 21, 2020, 11 pages.

* cited by examiner

*Primary Examiner* — Scott J Walthour
(74) *Attorney, Agent, or Firm* — Avant Law Group, LLC

(57) ABSTRACT

A system for retaining a cross fire tube in a multi-combustor gas turbine engine is disclosed. The system comprises a flow sleeve having a generally annular body, and a flange at a forward end thereof and having one or more recessed portions. A cross fire tube extends through one or more openings in the flow sleeve and is secured in place by a retention clip. The retention clip includes a plurality of fingers which engage the cross fire tube and a mounting plate engaging the one or more recessed portions of the flow sleeve flange so as to create a clip engagement having a lower profile than prior art configurations.

8 Claims, 8 Drawing Sheets

FIG. 1 - Prior Art

FIG. 2 – Prior Art

FIG. 3 – Prior Art

FIG. 4 - Prior Art

CROSS FIRE TUBE RETENTION SYSTEM

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

This present disclosure relates generally to a system for retaining a cross fire tube in a gas turbine combustor. More specifically, embodiments of the present disclosure relate to a flow sleeve and retention clip used to secure a cross fire tube in proper axial and radial position while also reducing blockage to a surrounding air passageway.

BACKGROUND OF THE DISCLOSURE

A gas turbine engine typically comprises a multi-stage compressor coupled to a multi-stage turbine via an axial shaft. Air enters the gas turbine engine and passes through the compressor where its temperature and pressure increase as it passes through subsequent stages of the compressor. The compressed air is then directed to one or more combustors where it mixes with a fuel source to create a combustible mixture. This mixture is ignited in the one or more combustors to create a flow of hot combustion gases. These gases are directed into the turbine causing the turbine to rotate, thereby driving the compressor. The output of the gas turbine engine can be mechanical thrust via exhaust from the turbine or shaft power from the rotation of an axial shaft, where the axial shaft can drive a generator to produce electricity.

In a typical industrial gas turbine engine, the combustor section comprises a plurality of can-annular combustors. In this configuration, a plurality of individual combustors is arranged about the axis of the gas turbine engine, where each combustor receives a portion of the compressed air from the compressor. However, in order to eliminate the need for ignition sources in each combustor for use at start-up as well as any time a combustor flashes back or when a flame is unintentionally extinguished, the plurality of individual combustors is connected by a plurality of cross fire tubes. In operation, one combustor can be ignited, and the flame will pass through the cross fire tubes to an adjacent combustor, thereby igniting a combustible mixture in an adjacent combustor.

A cross fire tube arrangement in accordance with the prior art is disclosed in FIGS. 1-4. Referring initially to FIG. 1, a flow sleeve 100 is shown and includes a plurality of openings 102 in the wall of the flow sleeve. The flow sleeve 100 also includes a plurality of lugs 104, which are used for positioning a combustion liner within the flow sleeve 100. Also located within the flow sleeve 100 are a plurality of brackets 106, which are more clearly depicted in FIG. 2. The cross fire tubes 108 are placed through the openings 102 and brackets 106, as shown in FIG. 3.

Referring now to FIG. 4, the cross fire tubes 108 are secured in the flow sleeve/liner by a clip 110. The clip 110 includes a hook portion 112 which can be used to help install and remove the clip 110 from the flow sleeve 100. As a result of the configuration of the bracket 106 and clip 110, each of these features extend inward and into a flow path between the flow sleeve 100 and combustion liner (not shown), thus interfering and restricting the flow of air passing between the flow sleeve 100 and a combustion liner. In a common configuration, the bracket 106 and clip 110 extend over half an inch into the flow path of the passing airflow thus adversely impacting air flow to a combustor and combustion dynamics and emissions.

BRIEF SUMMARY OF THE DISCLOSURE

The following presents a simplified summary of the disclosure to provide a basic understanding of some aspects thereof. This summary is not an extensive overview of the application. It is not intended to identify critical elements of the disclosure or to delineate the scope of the disclosure. Its sole purpose is to present some concepts of the disclosure in a simplified form as a prelude to the more detailed description that is presented elsewhere herein.

The present disclosure provides a system for retaining a cross fire tube within a gas turbine combustor, including a flow sleeve and retention clip configuration reducing potential blockage to an air passageway between the flow sleeve and a combustion liner.

In an embodiment of the present disclosure, a flow sleeve for a gas turbine combustion system is provided. The flow sleeve comprises a generally annular body having a flange at a forward end thereof and one or more openings in the generally annular body for receiving one or more cross fire tubes from an adjacent combustion chamber. The flow sleeve further comprises one or more recessed portions in the flange and a clip block having a T-shaped cross section positioned axially between the one or more recessed portions and the one or more openings.

In an alternate embodiment of the present disclosure, a system for retaining a cross fire tube between adjacent combustors in a gas turbine engine is disclosed. The system comprises a flow sleeve having a generally annular body, a flange at a forward end of the generally annular body, where the flange has one or more recessed portions. The generally annular body has one or more openings and a clip block having a T-shaped cross section positioned axially between the one or more recessed portions and the one or more openings. A cross fire tube extends through each of the one or more openings and is secured by a retention clip which extends along an inner surface of the generally annular body and has a mounting plate engaging the one or more recessed portions of the flow sleeve flange. A centerbody extends from the mounting plate and a first finger and a second finger extend from the center body, where the first and second fingers surround a portion of the tube, thus preventing the tube from moving into or out of the one or more openings in the generally annular body.

In yet another embodiment of the present disclosure, a retention clip for securing a cross fire tube in a gas turbine combustor is provided. The retention clip comprises a mounting plate, a centerbody extending from the mounting plate where the centerbody has a through hole and a slot extending away from the through hole. A first finger and a second finger extend from the center body, where the first and second fingers have an axially extending space therebetween. The retention clip has at least one curved portion extending along the centerbody such that the first and second fingers provide a spring tension when the clip is secured to the flow sleeve.

The present disclosure is aimed at providing an improved way of securing cross fire tubes between adjacent combustors while also reducing any interference into the surrounding passageway. These and other features of this disclosure can be best understood from the following description and claims.

BRIEF DESCRIPTION OF THE SEVERAL VIEWS OF THE DRAWINGS

The present disclosure is described in detail below with reference to the attached drawing figures, wherein.

DETAILED DESCRIPTION

The present disclosure is intended for use in a gas turbine engine, such as a gas turbine used for aircraft engines and/or power generation. As such, the present disclosure is capable of being used in a variety of turbine operating environments, regardless of the manufacturer.

As those skilled in the art will readily appreciate, a gas turbine engine is circumferentially disposed about an engine centerline, or axial centerline axis. The engine includes a compressor, a combustion section and a turbine with the turbine coupled to the compressor via an engine shaft. As is well known in the art, air compressed in the compressor is mixed with fuel and ignited in the combustion section and then expanded in the turbine. For certain gas turbine engines, such as industrial gas turbines used in power generation, the combustion system comprises a plurality of interconnected can-annular combustion chambers. The chambers are connected by a plurality of tubes for passing a flame between adjacent combustors to aid in the ignition process.

Figure 1:
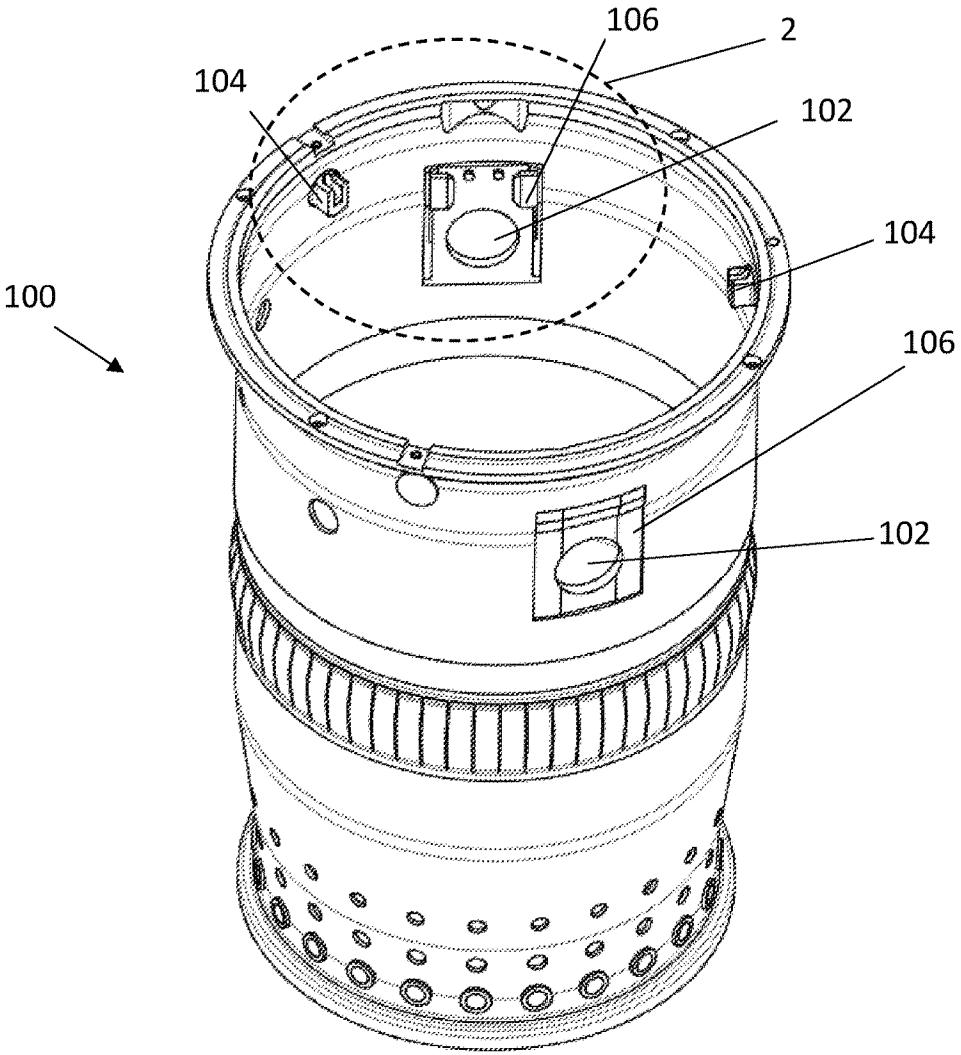
FIG. 1 is a perspective view of a flow sleeve of a gas turbine combustor in accordance with the prior art.
Figure 2:
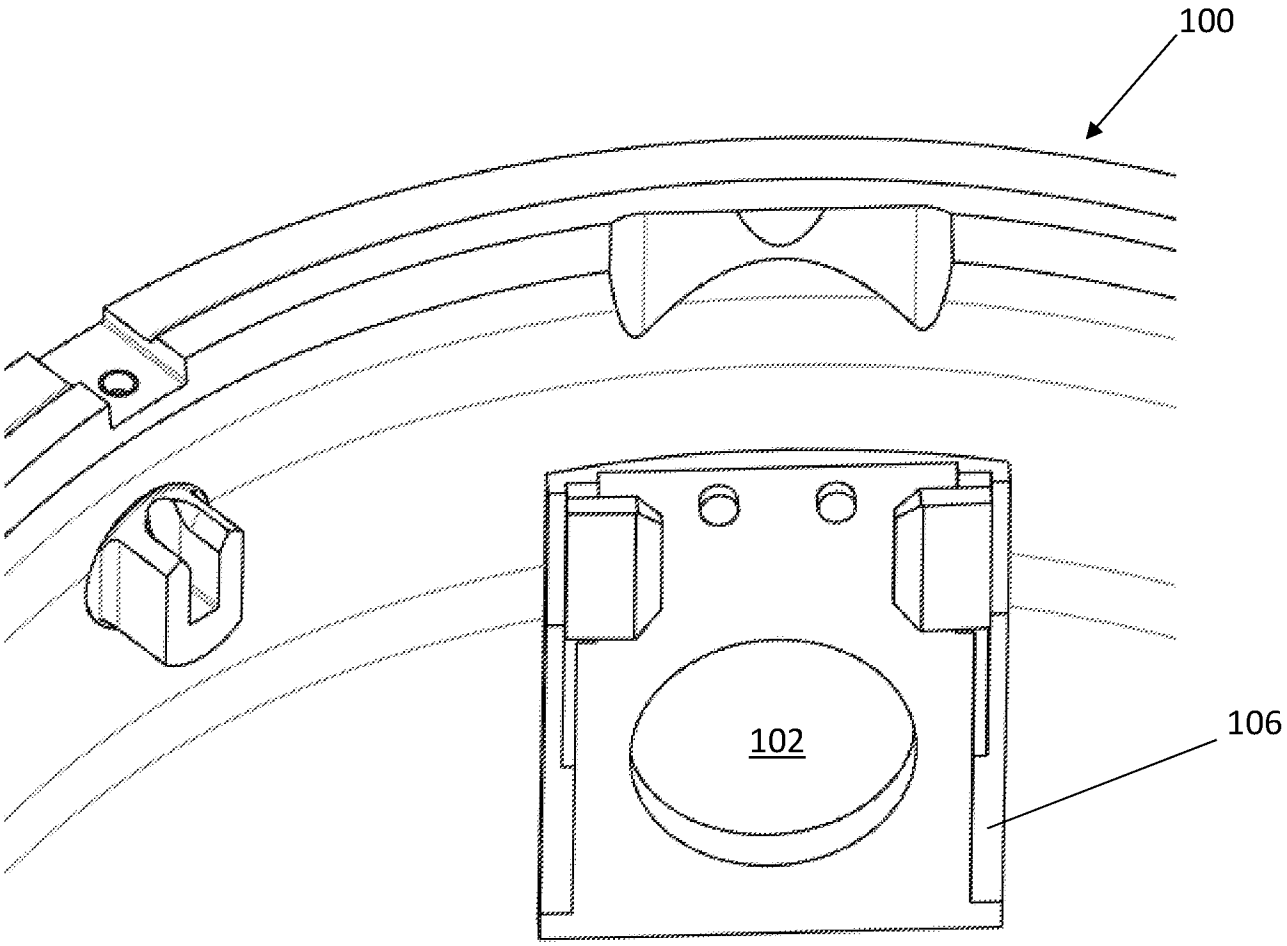
FIG. 2 is a detailed perspective view of a portion of the flow sleeve of FIG. 1 in accordance with the prior art.
Figure 3:
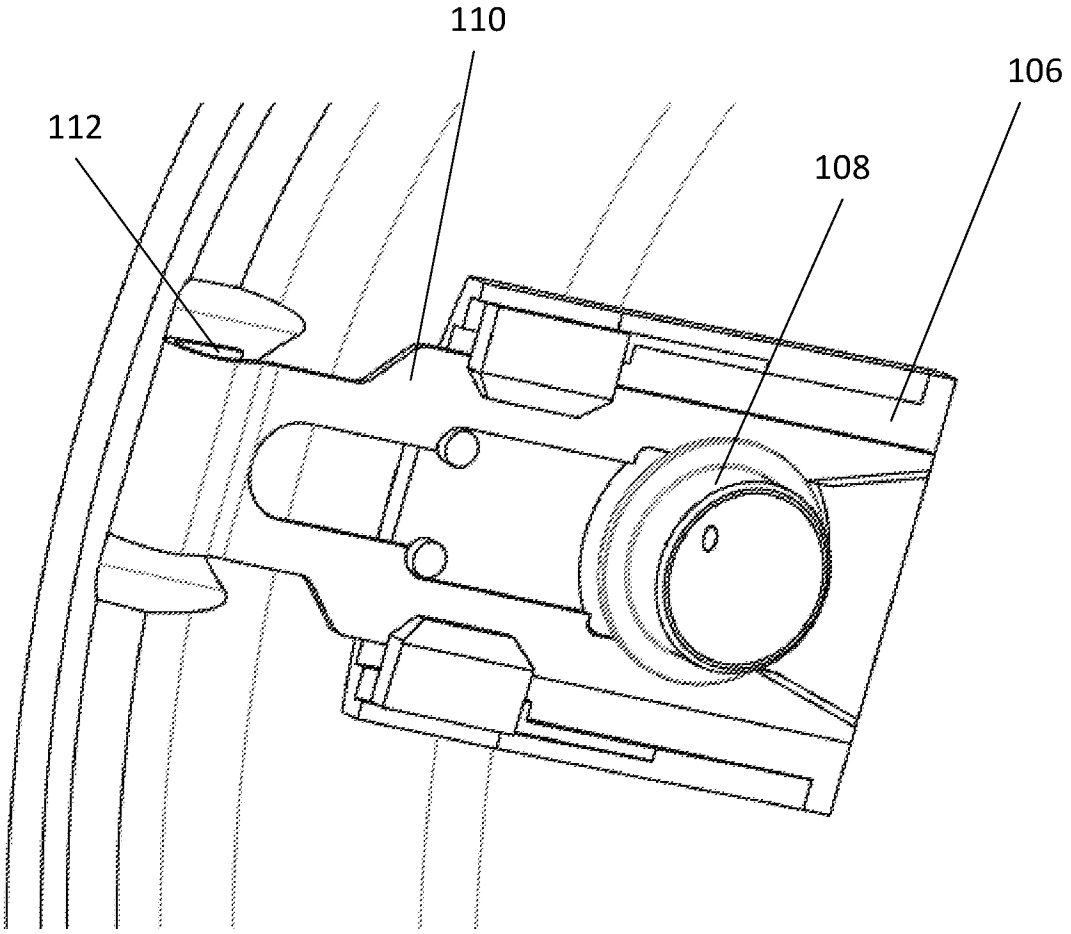
FIG. 3 is a detailed perspective view of a cross fire tube retention system in accordance with the prior art.
Figure 4:
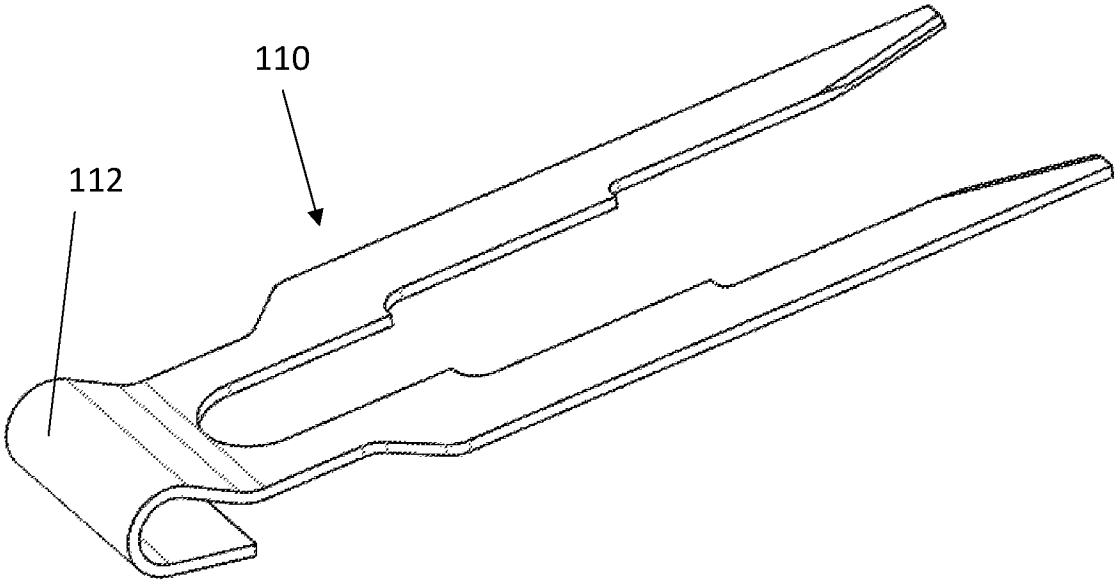
FIG. 4 is a perspective view of a retention clip in accordance with the prior art.
Figure 5:
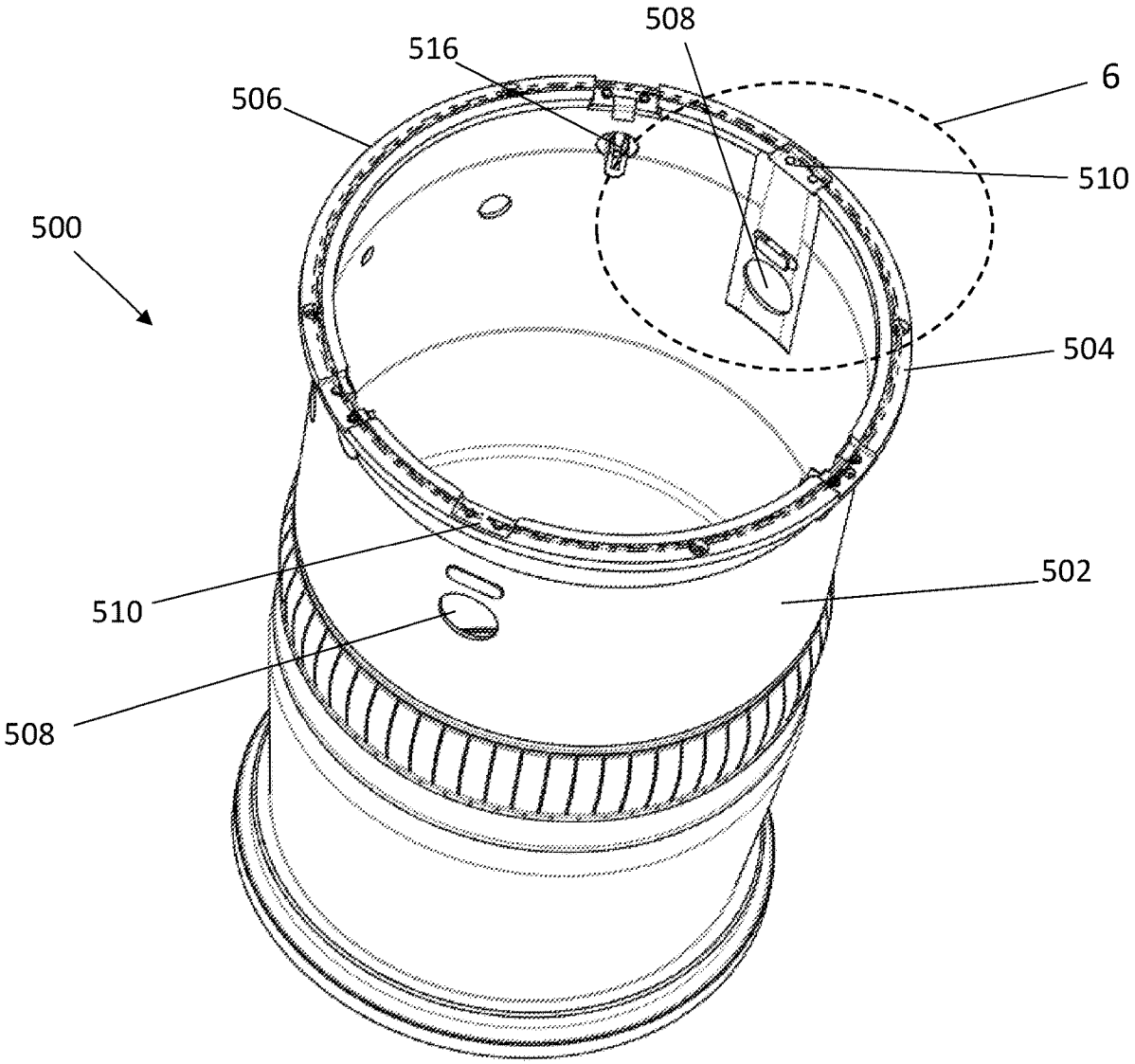
FIG. 5 is a perspective view of a flow sleeve of a gas turbine combustor in accordance with an embodiment of the present disclosure.

The present disclosure is depicted in FIGS. 5-8. Referring initially to FIG. 5, a flow sleeve 500 for use in a gas turbine combustion system is shown. The flow sleeve 500 comprises a generally annular body 502 having a flange 504 at a forward end 506 of the generally annular body 502. The flow sleeve 500 also includes one or more openings 508 spaced about the generally annular body 502. These one or more openings 508 are preferably two openings, as shown in FIG. 5, and are used for communicating with combustors adjacent to the flow sleeve 500. This communication occurs via a plurality of cross fire tubes which serve as a conduit in which a flame can be passed from one combustor to an adjacent combustor.

Figure 6:
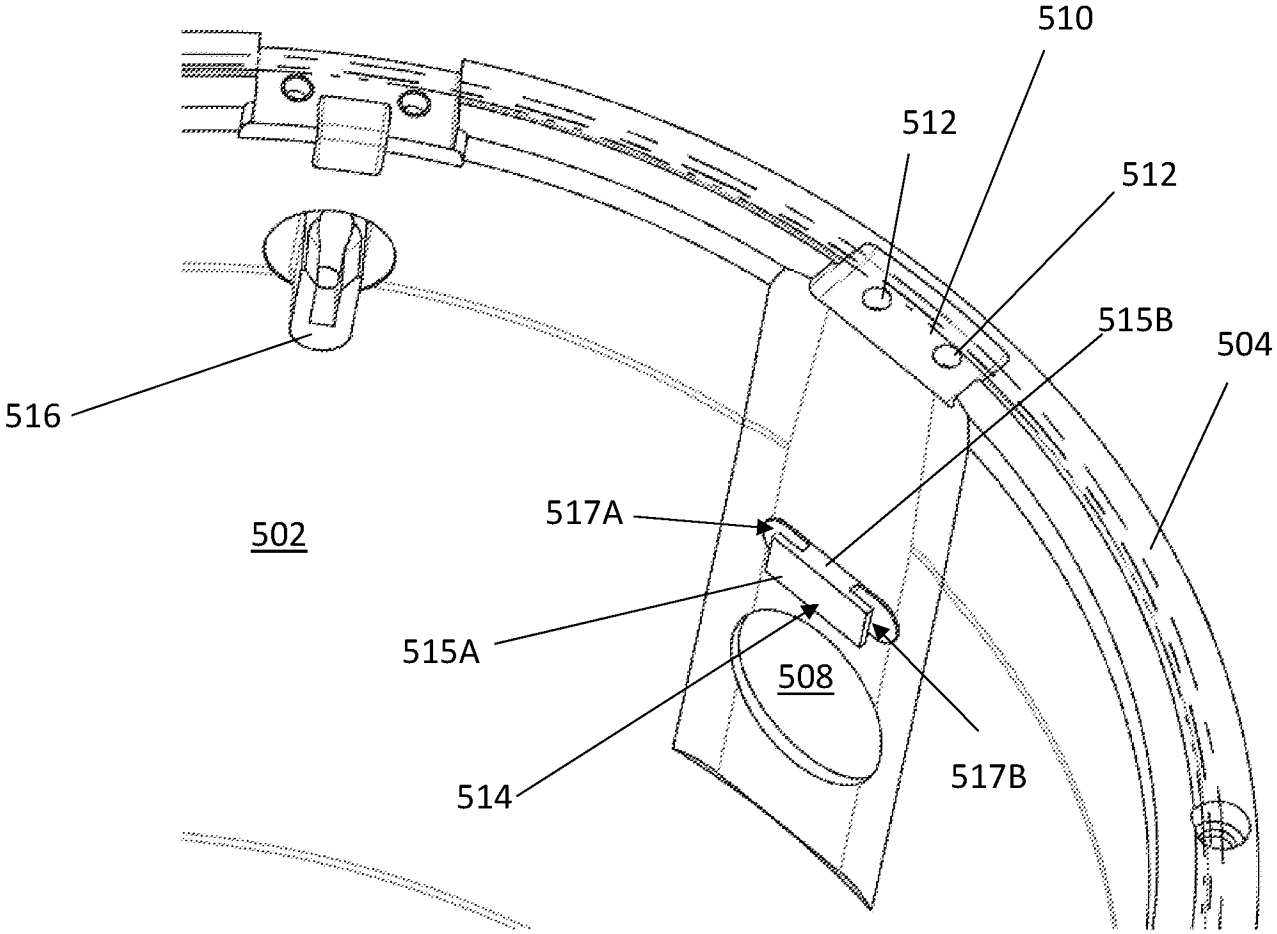
FIG. 6 is a detailed perspective view of a portion of the flow sleeve of FIG. 5 in accordance with an embodiment of the present disclosure.

Referring now to FIGS. 5 and 6, the flange 504 of flow sleeve 500 further comprises one or more recessed portions 510. The one or more recessed portions 510 correspond directly to the one or more openings 508 in the generally annular body 502. Thus, for the embodiment of the present disclosure shown in FIG. 5, the flow sleeve 500 includes two recessed portions 510 in the flange 504. Within the recessed portions 510 is a plurality of holes 512 which provide a way of securing a retainer clip, as will be discussed in more detail below. The plurality of holes 512 can be through holes or threaded.

The flow sleeve 500 also comprises a clip block 514 positioned axially between the one or more recessed portions 510 and the one or more openings 508. The clip block 514, which in one embodiment is welded to the generally annular body 502, is used to secure a retainer clip and cross fire tube in place, as discussed in more detail below. The clip block 514 can be formed of a variety of shapes depending on the specific cross fire tube and retainer clip geometry. For the embodiment depicted in FIGS. 5-8, the clip block 514 has a T-shaped cross section. In an embodiment, the clip block 514 has a first leg 515A and a second leg 515B generally perpendicular thereto. When the clip block 514 is secured (e.g., welded) to the generally annular body 502, a gap 517A may be formed between the annular body 502 and the first leg 515A at one side of the second leg 515B, and a gap 517B may be formed between the annular body 502 and the first leg 515A at an opposing side of the second leg 515B.

As discussed above, in a can-annular combustor configuration, a combustion liner is located within a flow sleeve. Compressed air from an engine compressor is directed between the combustion liner and flow sleeve in order to cool the combustion liner and direct the air into the combustion liner. As a result, this air is also preheated before entering the combustion liner and undergoes a combustion process to generate hot combustion gases for powering the turbine section. In order to properly locate the combustion liner within the flow sleeve, a plurality of pegs 516 extend radially inward from the generally annular body 502. Mounting tabs extend radially outward from a combustion liner and slide into the slots in the plurality of pegs 516.

Figure 7:
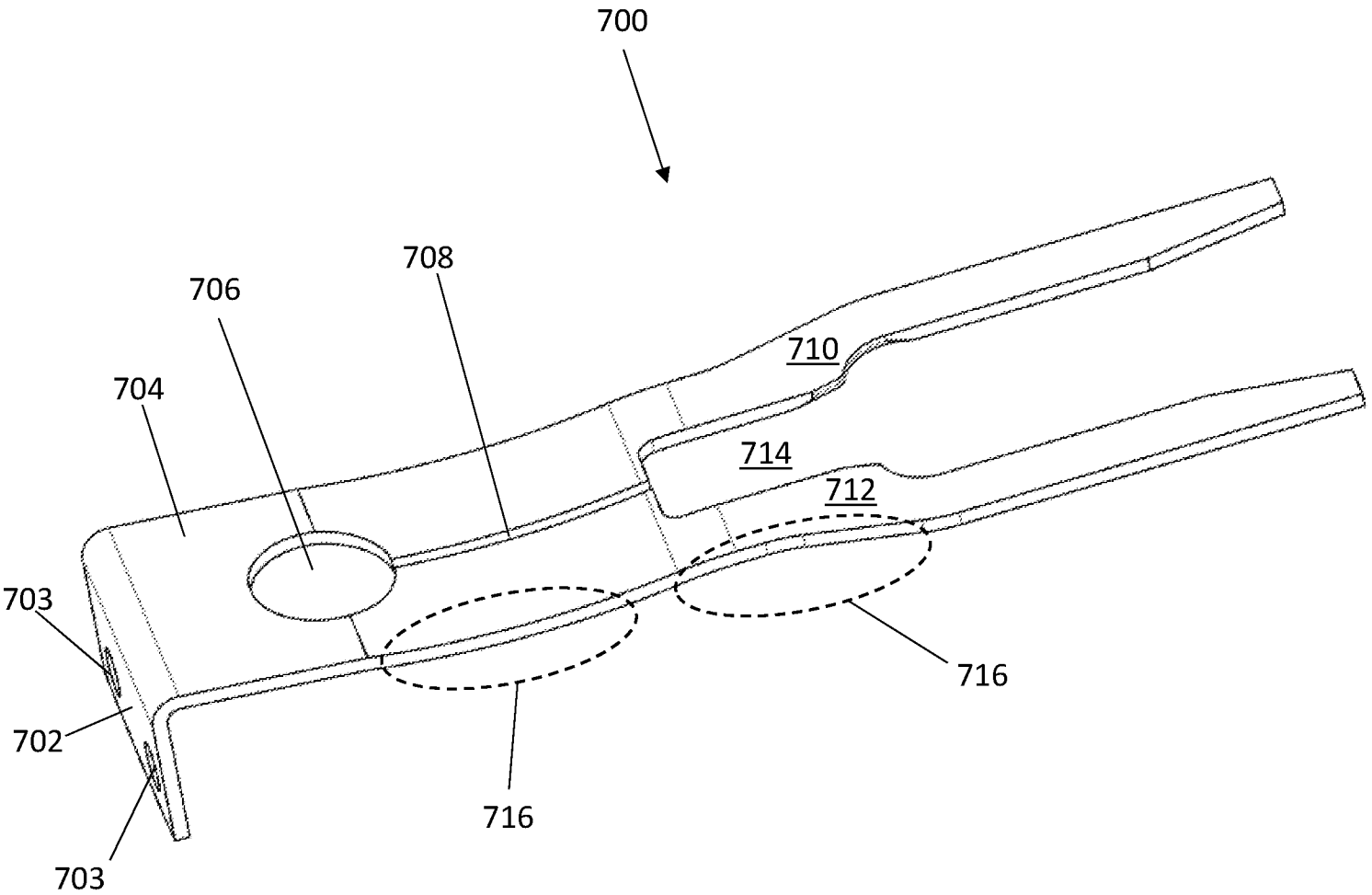
FIG. 7 is a perspective view of a retention clip in accordance with an embodiment of the present disclosure.

Another feature of the present disclosure is shown in FIG. 7. A retention clip 700 is provided for securing a cross fire tube in a gas turbine combustor. The retention clip 700 comprises a mounting plate 702 having one or more mounting holes 703 located therein and a centerbody 704 extending from the mounting plate 702. As can be seen in FIG. 7, the mounting plate 702 is generally perpendicular to the centerbody 704. The centerbody 704 has a through hole 706 and a slot 708 extending away from the through hole 706. Extending away from the centerbody 704 are two fingers, a first finger 710 and a second finger 712. The first finger 710 is separated from the second finger 712 by an axially extending space 714. The axially extending space 714, the slot 708, and the through hole 706 permit the first and second fingers 710 and 712 to expand in opposing directions in multiple planes, such that the fingers can expand to surround another component positioned in the axially extending space 714.

Referring still to FIG. 7, another feature of the retention clip 700 is at least one curved portion, or bend, 716 that extends along a portion of the centerbody 704 and/or the first and second fingers 710 and 712. The at least one curved portion 716 shown in FIG. 7 comprises two portions curved in opposing directions. In the embodiment depicted, the at least one curved portion is located along the centerbody 704 between the through hole 706 and the first and second fingers 710 and 712. Furthermore, one curved portion 716 curves in a direction towards the mounting plate 702 while the adjacent curved portion 716 curves away from the mounting plate 702. This set of opposing curve portions creates a spring effect in the clip 700 when the clip 700 is placed against adjacent mating surfaces, such as the annular body 502 of flow sleeve 500.

The retainer clip can be made from a variety of materials but is preferably made in a flat pattern from a material capable of withstanding the temperatures adjacent the cross fire tubes as well as the adjacent components. Such acceptable materials may include a tool steel as well as Inconel® X-750, a nickel-chromium alloy. The retainer clip 700 can be cut from a plate, typically 0.062 inches to 0.125 inches thick. Features such as the through hole 706, slot 708, and axially extending space 714 are cut out of the plate material while in a flat pattern, typically by a laser or wire EDM and then the mounting flange 702 is bent at approximately 90-degree angle relative to the centerbody 704.

Figure 8:
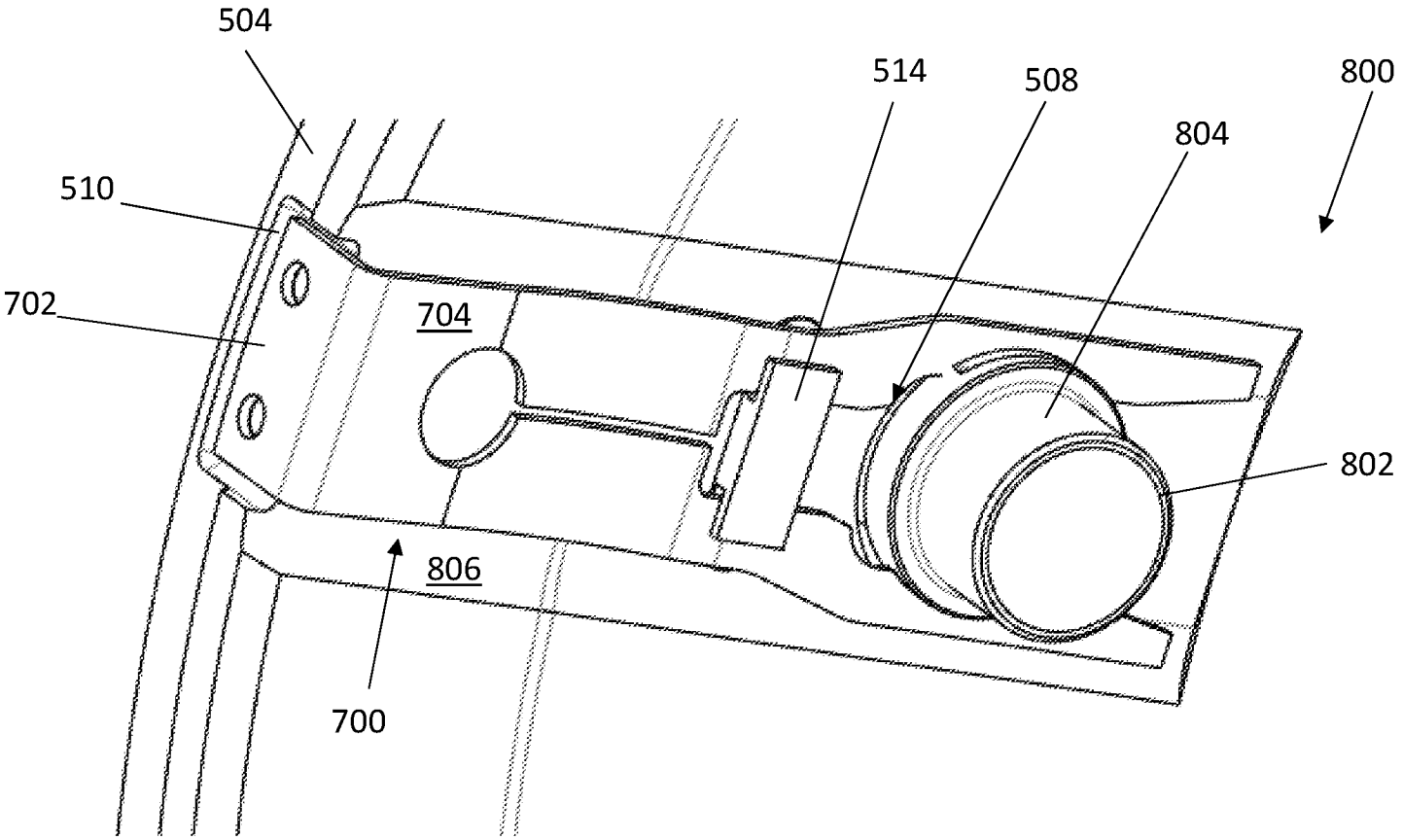
FIG. 8 is a detailed perspective view of a cross fire tube retention system in accordance with an embodiment of the present disclosure.

Referring now to FIG. 8, a system 800 for retaining a cross fire tube in a gas turbine engine having multiple combustors is disclosed. The system 800 utilizes the features discussed above with respect to FIGS. 5-7. As such, the terminology used to describe the system 800 and its assembly process will incorporate terms and reference identifiers discussed above.

The system 800 comprises a flow sleeve 500 having a generally annular body 502, a flange 504 with one or more recessed portions 510 located therein. The generally annular body 502 of the flow sleeve 500 also includes one or more openings 508 as well as a clip block 514 positioned between the one or more recessed portions 510 and the one or more openings 508.

A tube 802 extends through the one or more openings 508 of the flow sleeve 500. This tube, also known as a cross fire tube may comprise multiple tubes, often in a telescoping arrangement for connecting adjacent combustors. The tube 802 may also include a groove about its outer surface 804 for receiving the retention clip 700. As shown in FIG. 8, the retention clip 700 extends along an inner surface 806 of the generally annular body 502 with the mounting plate 702 engaging the recessed portion 510 in the flange 504. The centerbody 704 of the retention clip 700 extends from the mounting plate 702 and to the first finger 710 and the second finger 712, each of which surround a portion of the tube 802, thus preventing the tube 802 from moving into or out of the one or more openings 508 in the generally annular body 502.

In operation, once a flow sleeve is installed in adjacent combustor cases, one or more tubes 802, also commonly referred to as cross fire tubes, are passed through the openings 508 in the flow sleeve annular body 502. Then, a combustion liner is installed into the flow sleeve 500. Once the combustion liner is positioned within the flow sleeve 500, the tubes 802 are slid into the corresponding combustion liner. Once the tubes 802 are in the appropriate position through the flow sleeve and into the combustion liner, the retention clip 700 is positioned between the inner surface 806 of the generally annular body 502 and the clip block 514, such that each of the first finger 710 and second finger 712 extends at least partially through one of the gaps 517A and 517B and the fingers 710, 712 expand to surround at least a portion of the tube 802. The retention clip is slid into the flow sleeve 500 until the mounting plate 702 is positioned within the recessed portion 510 of the flange 504. Then, the mounting plate is secured to the flange 504 by placing a plurality of fasteners (not depicted) through mounting holes 703 in the mounting plate 702 and into the holes 512 in the recessed portion 510 of the flange 504.

Due to the curvatures 716 in the retention clip 700, and as discussed above, the retention clip 700 provides some resistance as it is positioned in place between the inner surface 806 of the generally annular body 502 and the clip block 514. This further aids in preventing accidental removal of the retention clip 700.

As can be seen from FIG. 8, the clip block 514 and retention clip 700 are positioned closer to the inner surface 806 of the generally annular body 502 than in prior art configurations. More specifically, the retention clip 700 of the present disclosure extends radially into the flow sleeve 500, and thus the airflow between the flow sleeve and combustion liner, by approximately 0.27 inches. The prior art configuration, as depicted in FIGS. 1-4, extends into the flow sleeve more than twice as much, or upwards of 0.56 inches, thereby creating a much larger blockage than the present disclosure. As one skilled in the art will appreciate, a blockage in compressed air can limit the air flow to the combustor, thus adversely impacting combustor emissions and impacting combustion dynamics.

Although a preferred embodiment of this disclosure has been provided, one of ordinary skill in this art would recognize that certain modifications would come within the scope of this disclosure. For that reason, the following claims should be studied to determine the true scope and content of this disclosure. Since many possible embodiments may be made of the disclosure without departing from the scope thereof, it is to be understood that all matter herein set forth or shown in the accompanying drawings is to be interpreted as illustrative and not in a limiting sense.

From the foregoing, it will be seen that this disclosure is one well adapted to attain all the ends and objects hereinabove set forth together with other advantages which are obvious, and which are inherent to the structure.

It will be understood that certain features and subcombinations are of utility and may be employed without reference to other features and subcombinations. This is contemplated by and is within the scope of the claims.

What is claimed is:

1. A system for retaining a cross fire tube in a multi-combustor gas turbine engine comprising:

a flow sleeve having an annular body, a flange at a forward end of the annular body having one or more recessed portions, one or more openings in the annular body, an indentation for holding the retention clip, the indentation extending into the annular body and meeting the one or more recessed portions, and a clip block having a T-shaped cross section positioned axially between the one or more recessed portions and the one or more openings;

a cross fire tube extending through each of the one or more openings; and a retention clip extending along an inner surface of the annular body and having a mounting plate engaging the one or more recessed portions, a centerbody extending from the mounting plate, and a first finger and a second finger extending from the center body;

wherein:

the first and second fingers surround a portion of the cross fire tube, thus preventing the cross fire tube from moving into or out of the one or more openings in the annular body; and the centerbody includes a through hole adjacent the mounting plate and a slot extending from the through hole and terminating at the first finger and the second finger, the slot having a lesser width than a width of the through hole.

2. The system of claim 1, wherein the mounting plate is perpendicular with respect to the centerbody.

3. The system of claim 1, wherein the mounting plate of the retention clip further comprises a plurality of mounting holes extending through the mounting plate.

4. The system of claim 3, further comprising a plurality of flange holes in each of the one or more recessed portions.

5. The system of claim 4, further comprising a plurality of fasteners for securing the retention clip to the flange of the flow sleeve.

6. The system of claim 1, wherein the centerbody further comprises an opening connected to the slot between the first and second fingers.

7. The system of claim 1, wherein the clip block is positioned between the first and second fingers.

8. The system of claim 1, wherein the cross fire tube extends through the one or more openings and into a combustion liner.

* * * * *